United States Patent [19]

Wedel

[11] Patent Number: 4,830,109

[45] Date of Patent: May 16, 1989

[54] CASING PATCH METHOD AND APPARATUS

[75] Inventor: Alfred W. Wedel, Houston, Tex.

[73] Assignee: Cameron Iron Works USA, Inc., Houston, Tex.

[21] Appl. No.: 114,639

[22] Filed: Oct. 28, 1987

[51] Int. Cl.[4] ..... E21B 29/10

[52] U.S. Cl. ..... 166/277; 166/242; 138/98

[58] Field of Search ..... 166/98, 242, 243, 277, 166/301; 138/97, 98, 99; 294/86.12, 86.14, 86.17, 86.26

[56] References Cited

U.S. PATENT DOCUMENTS

| | | | |
|---|---|---|---|
| 2,762,438 | 9/1956 | Naylor | 166/301 |
| 3,364,993 | 1/1968 | Skipper | 166/277 |
| 3,948,321 | 4/1976 | Owen et al. | 166/277 |
| 4,069,573 | 1/1978 | Rogers, Jr. et al. | 138/98 |
| 4,258,792 | 3/1981 | Restarick | 166/98 |
| 4,368,571 | 1/1983 | Cooper, Jr. | 138/97 |
| 4,580,826 | 4/1986 | Carver et al. | 294/86.12 |
| 4,660,863 | 4/1987 | Bailey et al. | 166/207 |
| 4,706,745 | 11/1987 | Bishop et al. | 294/86.17 |

*Primary Examiner*—Jerome W. Massie
*Assistant Examiner*—Terry Lee Melius
*Attorney, Agent, or Firm*—Vinson & Elkins

[57] ABSTRACT

The present invention relates to a method and an apparatus for making a casing patch while the casing is held under tension. The method includes the steps of lowering a casing patch tool to position the annular member to which the upper end of the casing is to be connected and a casing protection collar both in surrounding relationship to the upper end of the casing and with the cold forging tool and the tensioning spear within the casing, setting the spear within the casing at a level surrounded by the casing protection collar, pulling on the spear to tension the casing, and cold forging the casing into tight gripping and sealing engagement with the annular member. The apparatus includes the annular member to which the casing is to be connected, a guide sleeve on the lower end of the annular member sized to be lowered in the well bore and into surrounding relation to the upper end of the casing, a cold forging tool, a spear and a protection collar positioned within said annular member at the level of the spear so that it surrounds the casing to prevent excessive deformation on setting and tensioning by the spear. It is also a part of this invention to provide an improved method and apparatus for tensioning the casing and protecting it from excessive deformation as a result of the setting and tensioning of the spear by surrounding its exterior in the area of spear engagement with a protection collar which has sufficient strength and is sufficiently close around the casing to provide such protection.

5 Claims, 3 Drawing Sheets

CASING PATCH METHOD AND APPARATUS

BACKGROUND

When a casing within a well bore has been lost or cut loose for any reason, a connection to the upper end of the casing is attempted. This type of connection is also used in the event the casing has stuck to adjust the vertical position of the top of the casing. Such connection is referred to herein as a casing patch. It is preferred that the casing patch be made to a hanger or other suitable equipment which can be supported within a wellhead housing and that the casing be held in tension during the making of the patch.

A particularly advantageous manner of providing such casing patch is to provide a cold forging tool which is positioned within the casing and a hanger having a gripping and sealing interior contour positioned around the casing near its upper end. U.S. patent application Ser. No. 044,409, filed Apr. 30, 1987 discloses a cold forging method, apparatus and tool therefor which can be used to make a casing patch.

Casing which is in a well bore as a "fish" can be engaged internally by a device commonly referred to as a spear and when the spear has engaged, tension can be exerted on the string in which the spear is engaged to exert a tension on the casing. One disadvantage which has been encountered with the use of spears to tension casing is that considerable radial loading may be necessary on the casing and to prevent slipping of the spear, the spear slips are highly loaded. Also, the tensioning can also increase the loading of the slips against the interior of the casing. Such high slip loading has caused excessive deformation of the casing in the past.

SUMMARY

The present invention relates to a method and an apparatus for making a casing patch while the casing is held under tension. The method includes the steps of lowering a casing patch tool to position the annular member to which the upper end of the casing is to be connected and a casing protection collar both in surrounding relationship to the upper end of the casing and with the cold forging tool and the tensioning spear within the casing, setting the spear within the casing at a level surrounded by the casing protection collar, pulling on the spear to tension the casing, and cold forgoing the casing into tight gripping and sealing engagement with the annular member. The apparatus includes the annular member to which the casing is to be connected, a guide sleeve on the lower end of the annular member sized to be lowered in the well bore and into surrounding relation to the upper end of the casing, a cold forging tool, a spear and a protection collar positioned within said annular member at the level of the spear so that it surrounds the casing to prevent excessive deformation on setting and tensioning by the spear. It is also a part of this invention to provide an improved method and apparatus to protect the casing from excessive deformation by surrounding its exterior in the area of spear engagement with a protection collar.

It is an object of the present invention to provide an improved method and apparatus for the installation of a casing patch which is done with the casing under tension and without excessive deformation to the casing.

Another object is to provide an improved method and apparatus for effecting a casing patch in which the unit is tensioned by a spear which engages within the upper end of the casing so that the casing below such spear engagement is under tension as it is cold forged into tight gripping and sealing engagement within an annular member surrounding the casing.

A further object is to provide an improved spear and method of tensioning a string which protects the string being engaged by the spear from excessive deformation by the spear slip loading and the tension loads.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
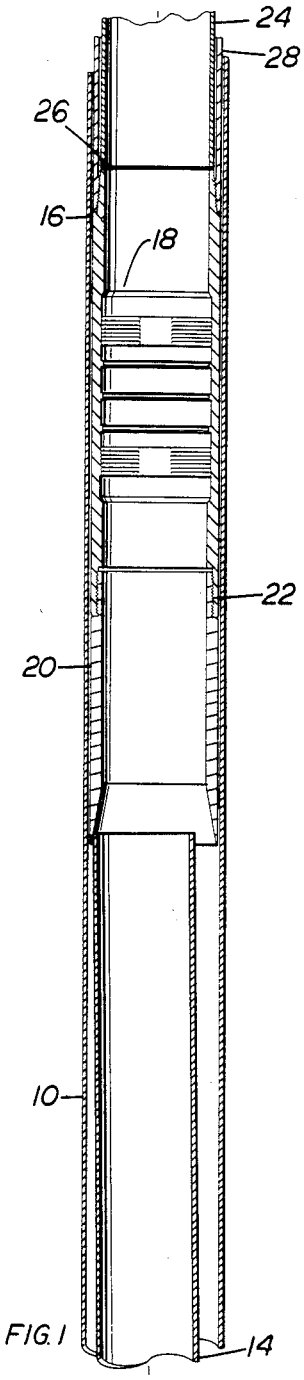
FIG. 1 is a detail sectional view of a well bore showing a casing in the lower portion thereof and an annular member with a protection collar supported within said annular member and a guide sleeve on lower end of the annular member being lowered within the well bore into surrounding relationship to the upper end of the casing fish.
Figure 2:
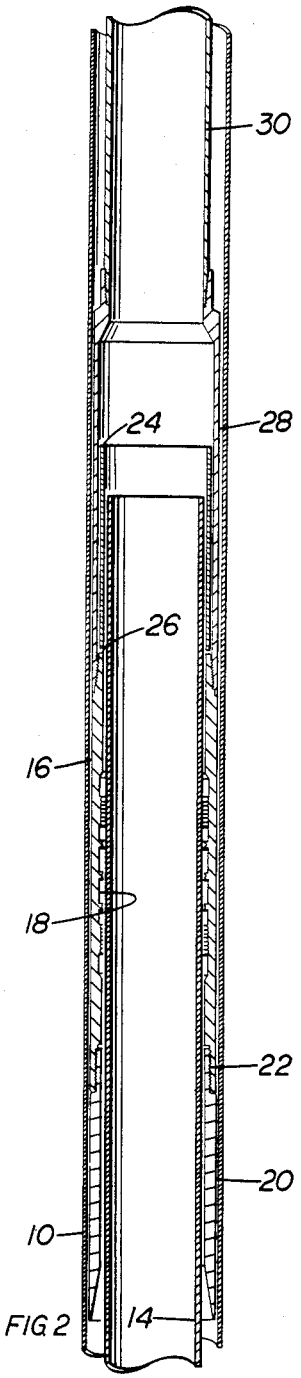
FIG. 2 is a view similar to FIG. 1 but illustrates the position at which the annular member is supported for subsequent operations.

As shown in FIG. 1, outer casing 10 is positioned within a well bore and inner casing fish 14 is positioned within outer casing 10. Annular member 16 having an internal contoured recess 18 has guide sleeve 20 secured to its lower end as by threads 22. The lower interior of guide sleeve 20 is tapered so that it will cause the upper end of inner casing fish 14 to move into the interior of guide sleeve 20. Protection collar 24 is positioned on upwardly facing shoulder 26 on the upper end of annular member 16 and within tubular connector 28 which is threaded onto the upper exterior of annular member 16. With the upper end of inner casing fish 14 within guide sleeve 20, guide sleeve 20, annular member 16 and protection collar 24 are lowered until the upper end of inner casing fish 14 is within the upper half of protection coolar 24. Connector 28, as shown in FIG. 2, is secured to the lower end of string 30 on which the outer assembly described is lowered.

Figure 3:
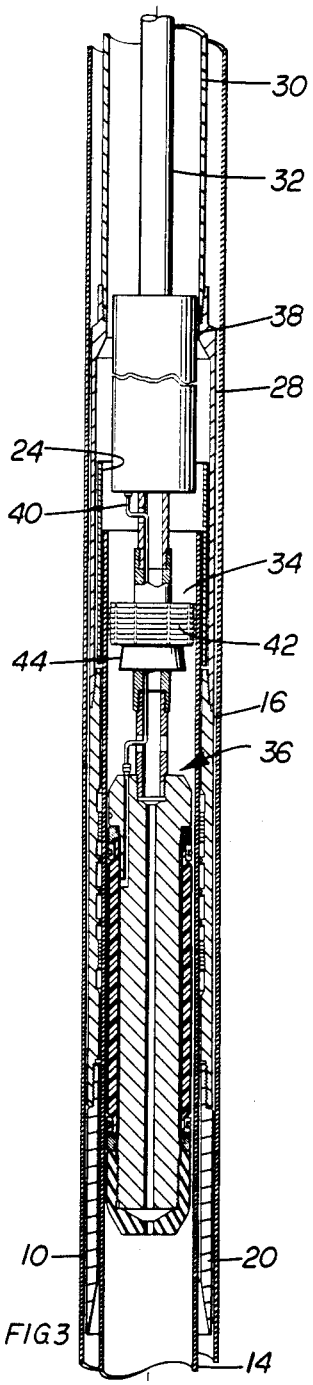
FIG. 3 is another similar view showing the cold forging tool and the spear after they have been lowered to a preselected position within the casing fish.

With the outer assembly positioned as described above, the inner assembly is lowered through string 30 on drill pipe 32 to position spear 34 within the upper end of casing fish 14 and at a level at which casing fish 14 is surrounded by protection collar 24, forging tool 36 is within casing fish 14 below spear 34 and at least partially below the lower level of contoured recess 18 as shown in FIG. 3. Pump and instrument pod 38 is positioned above spear 34 on drill pipe 32. Tubing 40 connects from pod 38 through spear 34 into tool 36 to provide the pressure fluid for the actuation of tool 36. Tool 36 is preferred to be a tool such as is disclosed in the copending application Ser. No. 07,114,422, filed Oct. 28, 1987. Spear 34 is any suitable available spear which includes other slips 42 and an inner mandrel 44 which moves axially of the slips 42 to wedge them outward into gripping engagement with the interior of the upper end of casing fish 14. As mentioned above, tool 36 is positioned below its desired position with respect to contour recess 18 by a distance which includes the anticipated elongation of the casing fish 14 and the distance the spear mandrel 44 is estimated to travel to properly and completely set slips 42.

Figure 4:
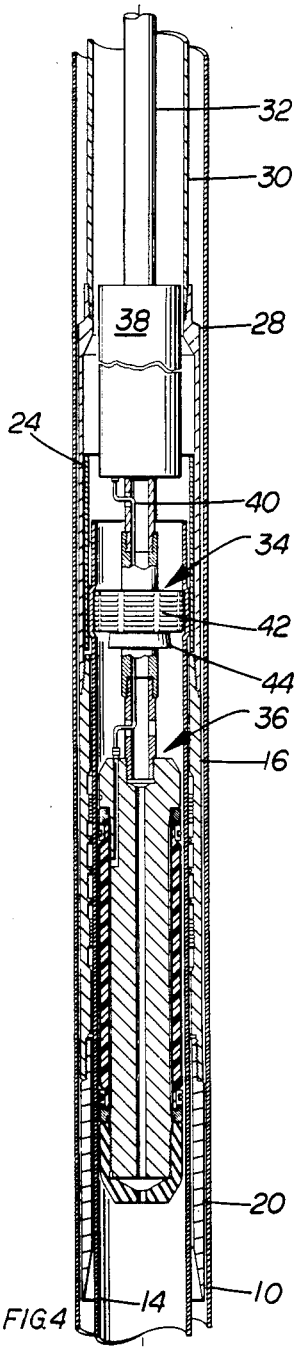
FIG. 4 is another similar view showing the setting of the spear within the upper end of the casing fish.

FIG. 4 illustrates the relative position of the inner and outer assemblies after the spear mandrel 44 has been moved upwardly within slips 42 causing slips 42 to be moved outward into tight gripping engagement within the upper end of casing fish 14. It should be noted that tool 36 has been moved upwardly within annular member 16 the distance of the setting movement of spear mandrel 14 but tool 36 is still below the upper end of contoured recess 18. The gripping engagement of spear 34 into the interior of casing 14 causes casing 14 to be forced outward into engagement with protection collar 24. Collar 24 is sufficiently thick and strong so that further distortion of casing 14 responsive to the gripping forces of spear 34 is prevented.

Figure 5:
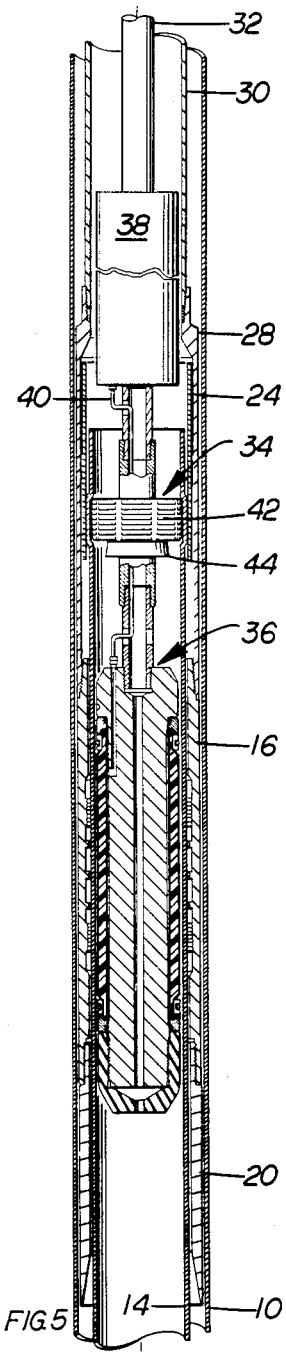
FIG. 5 is another similar view showing the tensioning of the casing fish by lifting of the string supporting the spear and forging tool.
Figure 6:
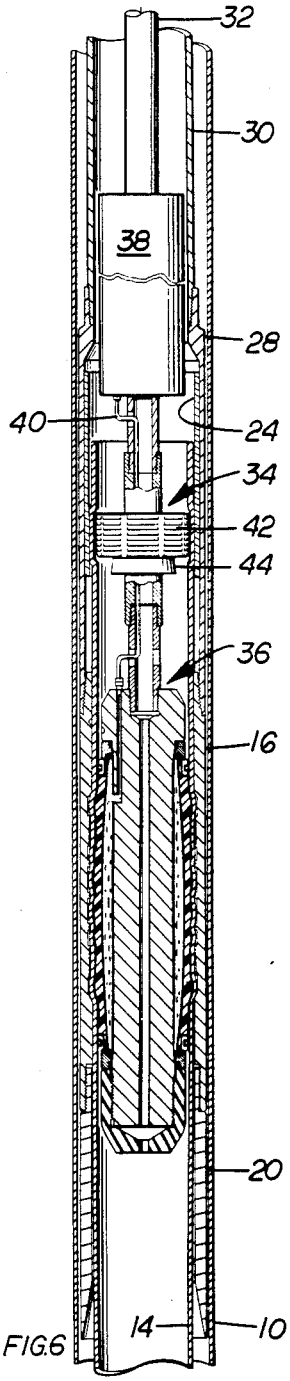
FIG. 6 is another similar view illustrating the cold forging connection being made between the casing fish and the contour on the interior of the annular member.

FIG. 5 illustrates the positions of the components after spear 34 has been set and lifted by drill pipe 32 to effect the desired amount of tension in casing fish 14. This has caused casing fish 14 to elongate and inner assembly to be raised so that tool 36 is positioned at the desired level within annular member 16. In this position the forging of casing fish 14 is outward into internal contoured recess 18 of annular member 16. This forging step is illustrated in FIG. 6. When such forging is completed responsive to the delivery of fluid under pressure from pod 38 through tubing 40 into tool 36, the resilient packing is forced outward forcing the portion of casing 14 which it engages outward into tight sealing and gripping engagement with internal contoured recess 18.

Figure 7:
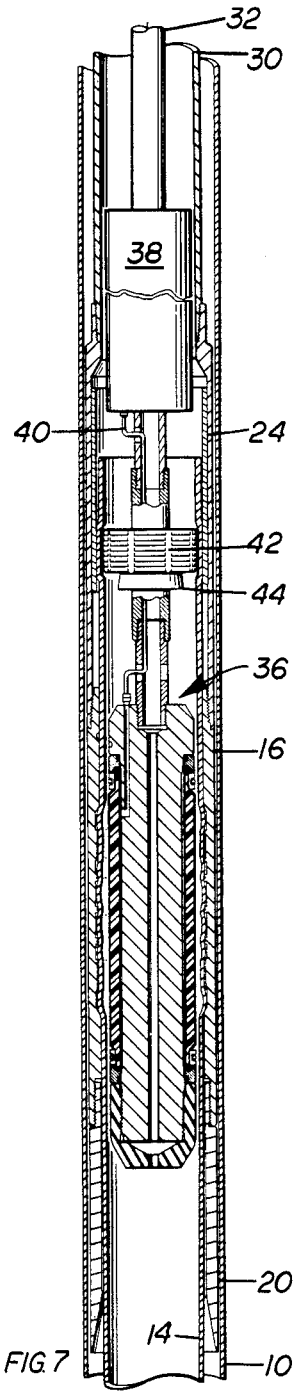
FIG. 7 is another similar view showing the release of the cold forging tool from the interior of the casing fish.
Figure 8:
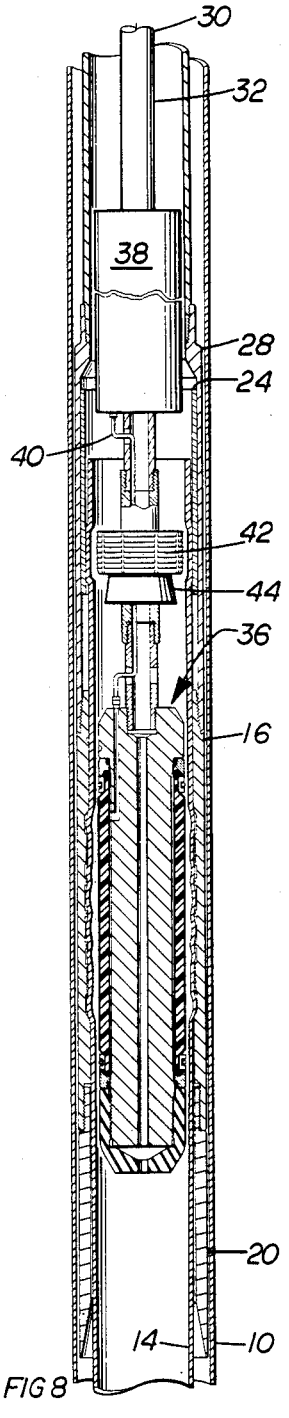
FIG. 8 is another similar view illustrating the release of the spear.
Figure 9:
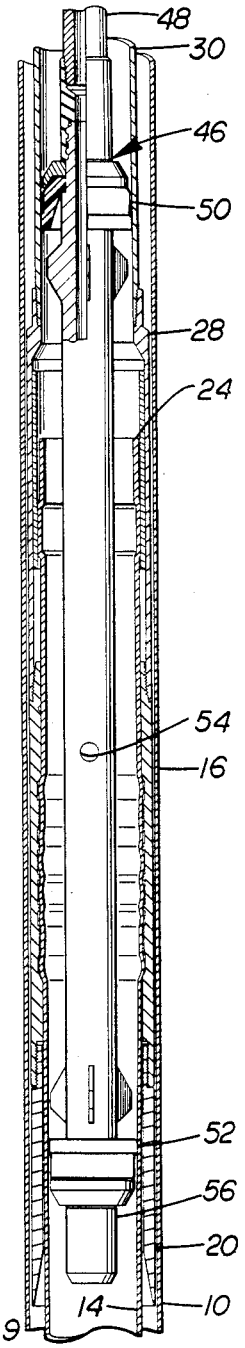
FIG. 9 is another similar view illustrating a pressure testing tool positioned within the annular member and the casing to pressure test the cold forged joint between the two.

With the completion of the forging step as described above, the pressure within tool 36 is relieved and its resilient packing relaxes back to its normal position immediately surrounding the body of tool 36. This position is shown in FIG. 7. Following the release of tool 36, spear 34 is released by lowering of drill pipe 32 to cause spear mandrel 44 to move out from under spear slips 42 and causing slips 42 to withdraw from engagement with casing 14. In this position, shown in FIG. 8, inner assembly is recovered from within outer causing 10 and pressure testing tool 46 is lowered on drill string 48 into the interior of annular member 16 and the interior of casing 14. In its set position as shown in FIG. 9, upper packing seal 50 is set within string 30 above connector 28 and above the upper end of of annular member 16. Lower packing seal 52 is set within casing 14 at a position below the portion of casing 14 which has been forged into engagement with contoured recess 18 within annular member 16. To test the sealing of the forged connection, pressure is delivered through drill string 48 and out its central opening 54. Since blind cap 56 is secured to the lower end of string 48, any loss of pressure notice at the surface in string 48 after it has been fully pressurized will indicated a leakage in the forged connection.

It should be noted that the use of the protection collar with the spear to protect the casing from excessive deformation responsive to the setting of the spear and its tension loading which increases the gripping loading on the casing may be used in application other than the method and apparatus for providing a casing patch.

What is claimed is:

1. The method of making a patch on a casing within a well bore including the steps of positioning an annular member having an internal configuration of lands and grooves around the upper portion end of the casing so that the lands and grooves surround a portion of the casing at a distance spaced below the upper end of the casing, lowering a forging tool and a spear into the upper end of the casing, setting the spear into gripping engagement with the casing at a position above the forging tool, lifting the spear to tension the casing, cold forging the casing into gripping and sealing engagement with the internal lands and grooves within the annular member, and releasing said retrieving the forging tool and the spear from within the casing.

2. The method of making a casing patch including the steps of positioning an annular member having an internal configuration of lands and grooves around the upper end of the casing, lowering a forging tool and a spear into the upper end of the casing, setting the spear into gripping engagement with the casing at a position above the forging tool, positioning a protective collar around the upper end of the casing at the level of engagement of the spear within the casing to limit the deformation of the casing responsive to the internal gripping of the spear, lifting the spear to tension the casing, cold forging the casing into gripping and sealing engagement with the internal lands and grooves within the annular member, releasing and retrieving the forging tool and the spear from within the casing.

3. An apparatus for making a casing patch within a well bore to a casing fish comprising an annular member having an internal contoured recess, means for lowering the annular member into a well bore into surrounding relationship to the casing fish, a forging tool, a spear connected to the upper end of the forging tool, means for lowering the forging tool and the spear into said casing fish, means for setting said spear within the upper portion of the casing fish and exerting a tensile force on the casing fish, means for actuating said forging tool to forge the casing below the portion engaged by the spear into gripping and sealing engagement with the internal contoured recess within said annular member, and means for releasing and retrieving the spear and the forging tool.

4. An apparatus for making a casing patch within a well bore to a casing fish comprising:

an annular member having an internal contoured recess, means for lowering the annular member into a well bore into surrounding relationship to the casing fish, a forging tool, a spear connected to the upper end of the forging tool, means for lowering the forging tool and the spear into said casing fish, means for setting said spear within the upper portion of the casing fish and exerting a tensile force on the casing fish, means for actuating said forging tool to forge the casing below the portion engaged by the spear into gripping and sealing engagement with the internal contoured recess within said annular member, means for releasing and retrieving the spear and the forging tool, and means surrounding the casing fish in the area engaged by the spear for protecting the casing fish from excessive deformation responsive to the engagement and tensile forces of the spear on the casing fish.

5. An apparatus for making a casing patch within a well bore to a casing fish comprising an annular member having an internal contoured recess, means for lowering the annular member into a well bore into surrounding relationship to the casing fish, a forging tool;

a spear connected to the upper end of the forging tool, means for lowering the forging tool and the spear into said casing fish, means for setting said spear within the upper portion of the casing fish and exerting a tensile force on the casing fish, means for actuating said forging tool to forge the casing below the portion engaged by the spear into gripping and sealing engagement within the internal contoured recess within said annular member, means for releasing and retrieving the spear and the forging tool, a testing tool having an upper and a lower packing seal and supported on a hollow member with an opening therein between the upper and lower packing seals and means for lowering the testing tool to position the packing seals above and below the forged connection and to deliver fluid under pressure to test the sealing engagement of the forged connection.

* * * * *